United States Patent [19]

Dalton

[11] 4,265,739

[45] May 5, 1981

[54] FLOTATION MACHINES AND COMPONENTS THEREOF

[76] Inventor: Robert W. Dalton, 7530 E. Calle Agerrida, Tucson, Ariz. 85715

[21] Appl. No.: 113,294

[22] Filed: Jan. 18, 1980

Related U.S. Application Data

[63] Continuation of Ser. No. 5,816, Jan. 23, 1979, abandoned, which is a continuation of Ser. No. 789,442, Apr. 20, 1977, abandoned.

[51] Int. Cl.[3] ..... B03D 1/16

[52] U.S. Cl. ..... 209/169; 261/93

[58] Field of Search ..... 209/169, 168; 210/221 R, 221 M; 261/87, 93

[56] References Cited

U.S. PATENT DOCUMENTS

| | | | |
|---|---|---|---|
| 2,343,274 | 3/1944 | Bailey et al. | 210/221 M X |
| 3,393,803 | 7/1968 | Daman et al. | 209/169 |
| 3,491,880 | 1/1970 | Reck | 209/169 X |

OTHER PUBLICATIONS

Modern Plastics Encyclopedia, 1973–1974, McGraw-Hill, NY, NY, vol. 50, No. 10A, Oct. 1973, pp. 554–555.

Denver "Sub-A", Super Rougher, Denver Equipment Co., Bulletin F10-B87.

Taggart, A. F., Handbook of Mineral Dressing, John Wiley and Sons, 1945, pp. 12–64 to 12–66.

D-R Denver Flotation, Denver Equipment Co., Bulletins F10-B116 and F10-B119.

*Primary Examiner*—Ralph J. Hill

*Attorney, Agent, or Firm*—Le Blanc, Nolan, Shur & Nies

[57] ABSTRACT

Froth flotation apparatus with mechanical agitation and aeration. Impeliers and diffusers therefor which are more durable and less expensive than the state-of-the-art components.

2 Claims, 4 Drawing Figures

FLOTATION MACHINES AND COMPONENTS THEREOF

This is a continuation of application Ser. No. 5,816, filed Jan. 23, 1979, which is in turn a continuation of Ser. No. 789,442 filed Apr. 20, 1977 (both now abandoned).

The present invention relates to froth flotation machines and, more particularly, to novel, improved, flotation machines of the subaeration type and to novel, improved components for such machines.

Subaeration type flotation machines have been widely used to separate and recover metallic and non-metallic minerals since early in the twentieth century. They have also been used for various other purposes; e.g., food purification, paper pulp deinking, and industrial waste treatment.

While machines of this character vary in structural design and operating details, they have certain features in common. These are a tank or box into which a pulp of the feed material in a liquid carrier is introduced and a stationary diffuser and rotating impeller at the bottom of the box for agitating and aerating the pulp, causing particles of the material being treated to become attached to bubbles of air. The air bubbles reduce the effective specific gravity of the attached solid particles, which aggregate and float to the top of the box and form a froth which can be recovered from the machine. By adding appropriate reagents to the pulp, selective reactions between the solid particles and the air bubbles can be effected so that the particles of one constituent in the material being treated will be substantially more apt to become attached to the air bubbles than the particles of the remaining constituents which can therefore be separately recovered or removed from the machine.

Solids subject to being separated by froth flotation machines are typically highly abrasive and corrosive. As a consequence, frequent replacement of the impeller and diffuser, the components most susceptible to corrosion and the abrasive action of the solid particles, has been a constant and expensive disadvantage of froth flotation machines since their inception.

Originally, froth flotation machines had metallic impellers and diffusers. These were particularly disposed to corrosion and erosion by the solids in the pulp.

At the present time, the art has progressed only to the extent of covering the diffuser and impeller with a rubber or other elastomer (see, for example, U.S. Pat. Nos. 2,928,543 issued Mar. 15, 1960, to Logue; 2,944,802 issued July 12, 1960, to Daman; 2,966,266 issued Dec. 27, 1960, to Coke; 3,140,255 issued July 7, 1964, to Daman; 3,327,851 issued June 27, 1967, to Anderson; 3,393,802 issued July 23, 1968, to Logue et al; 3,393,803 issued July 23, 1968, to Daman et al; and 3,491,880 issued Jan. 27, 1970, to Reck; Denver Equipment Company Bulletin No. F10-B119; and Joy Manufacturing Company Bulletin No. F10-B116).

After only a limited period, however, even these state-of-the-art impellers and diffusers wear to the point that they must be replaced.

The only other proposed solution to the corrosion-erosion problems of which I am aware as related to that shown in the patents identified in the preceding paragraph in that a composite construction is employed. Specifically, Morris U.S. Pat. Nos. 2,115,997 issued May 3, 1938, and 2,217,231 issued Oct. 8, 1940 and pages 12-70 and 12-71 of HANDBOOK OF MINERAL DRESSING, Taggart, John Wiley & Sons, Inc. New York, N.Y., 1927 (hereinafter "Taggert") disclose impellers with an insert or core of a more rigid rubber than the outer covering, or alternatively, of a rubberized fabric. These components are no longer used. They have been replaced in the Weinig type machine in which they were employed by metal impellers.

I have now discovered that this state-of-the-art combination of rigid insert or core and resilient covering is unnecessary and that flotation machine impellers and diffusers can instead, and advantageously, be constructed entirely, and without a core, from corrosion and abrasion resistant elastomers.

Diffusers and impellers constructed in accord with the principles of the present invention have a potentially longer service life than the state-of-the-art, elastomer covered components which they replace. As the cost of replacement components may run to over $1000 for a single machine and as a single installation may have several hundred flotation machines, the cost advantages of my invention are self-evident.

Also, because a composite structure is not required, manufacturing cost are lower, a further economic advantage.

Furthermore, the weight of an impeller-diffuser assembly in accord with the principles of my invention may be up to 70% less than that in the components it replaces. Machines in which they are installed therefore require less power. This is yet another cost advantage and, also, contributes to energy conservation and the quality of the environment. Also, the reduction in weight makes the component safer to handle during installation and at other times.

From the foregoing it will be apparent to the reader that one important and primary object of my invention resides in the provision of novel, improved froth flotation machines of the subaeration type.

Equally important and also primary objects of the invention reside in the provision of novel, improved impellers, diffusers, and impeller-diffuser assemblies for froth flotation machines.

Other important, but more specific objects of my invention reside in the provision of components and impeller-diffuser assemblies in accord with the preceding object:

(1) which have the potential for significantly reducing unit processing cost;

(2) which are less expensive to manufacture than the corresponding state-of-the-art components and assemblies;

(3) which require less power than the corresponding state-of-the-art components and assemblies;

(4) which are lighter and therefore safer to handle than corresponding state-of-the-art components;

(5) which are or have components fabricated without a core of a non-metallic, abrasion and corrosion resistant elastomer.

Yet another important, specific object of my invention resides in the provision of froth flotation machines having impellers and diffusers capable of meeting the above-stated objectives and, therefore, possessing the advantages provided thereby.

Other important objects and features and additional advantages of the invention will be apparent from the foregoing general description of the invention, from the appended claims, and from the ensuing detailed description and discussion as it proceeds in conjunction with the accompanying drawing, in which:

Figure 1:
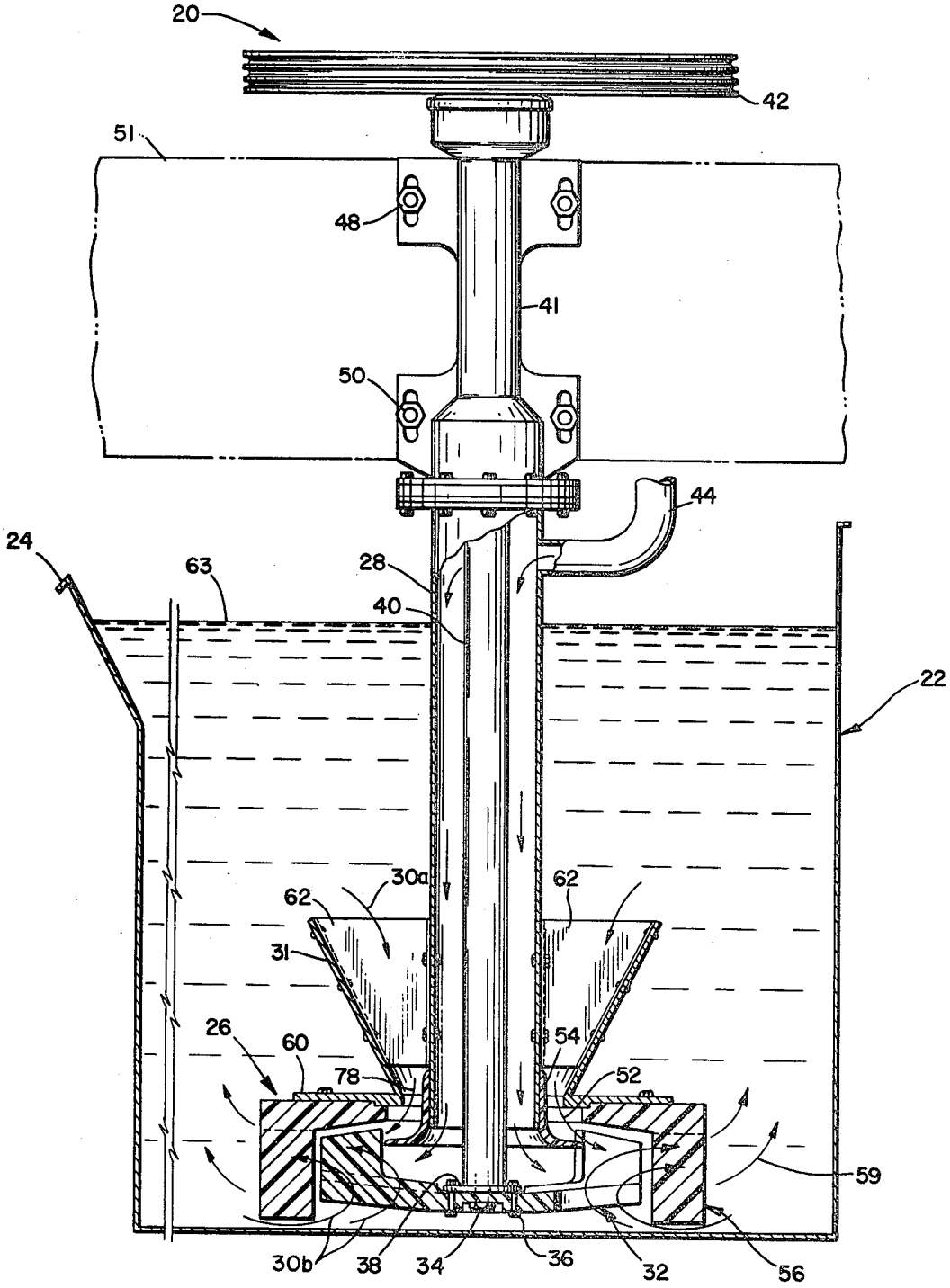
FIG. 1 is a vertical section through a flotation machine constructed in accord with and embodying the principles of the present invention.

Referring now to the drawing, FIG. 1 depicts a subaeration type, froth flotation machine 20 constructed in accord with and embodying the principles of the present invention.

The major components of machine 20 include an open-top tank or box 22 with an overflow lip 24, an impeller-diffuser assembly 26 in the bottom of the box, and a standpipe 28 through which air can be supplied to assembly 26.

Pulp is introduced into machine 20 through a feed conduit or weir or an opening in box 22 (not shown). The pulp circulates as shown by arrows 30*a* in FIG. 1 through a well 31 and upwardly from its lower side as shown by arrows 30*b* to the impeller 32 of impeller-diffuser assembly 26.

The impeller is attached by bolts 34 and torque-resisting pins 36 to a flange 38 to the lower end of a vertically extending, impeller shaft 40 rotatably supported in a spindle bearing housing 41. Shaft 40 is rotated by a pulley 42 fixed to its upper end as shown and illustrated on page 12-64 of Taggart.

Air is pumped to the rotating impeller 32 through a conduit 44 and standpipe 28. The standpipe surrounds impeller shaft 40 and is bolted to a flange on the lower end of spindle housing 41. Brackets 48 and 50 support the standpipe, spindle bearing housing, and impeller shaft from a structural framework 51 located above the tank 22 of machine 20.

Air pumped down standpipe 28 is directed into impeller 32 (see arrows 52 in FIG. 1) by a bonnet 54 fixed to the lower end of the standpipe. Impeller 32 reduces the air pumped to it to fine bubbles, aerates the pulp circulating to it by entraining the bubbles in the pulp, and keeps solids suspended in the liquid phase of the pulp.

The aerated pulp is discharged radially through the diffuser 56 of the impeller-diffuser assembly. The diffuser produces additional agitation and therefore finer dispersion of the air.

The solids dicharged from diffuser 56 and displaced upwardly as indicated by arrows 59 tend to recirculate through well 31 as indicated by arrows 30. This keeps the solids in suspension long enough to maximize the interaction between the particles and the entrained air bubbles.

Diffuser 56 is bolted or otherwise attached to a radial flange 60 at the lower end of well 31. The well is, in turn, supported from standpipe 28 by radial supports 62.

Particles attached to the bubbles and floated to the surface 63 of the pulp in tank 22 form a froth. This froth is displaced from tank 22 over lip 24, typically by a paddle wheel (see for example, FIG. 27, page 12-64 of Taggart). This device has not been shown as it is conventional and not part of my invention.

As thus far described, flotation machine 20 is of the construction shown in the above-cited patents and Taggart. It differs from these state-of-the-art machines primarily in the construction of the impeller 32 and diffuser 56 of impeller-diffuser assembly 26.

Figure 2:
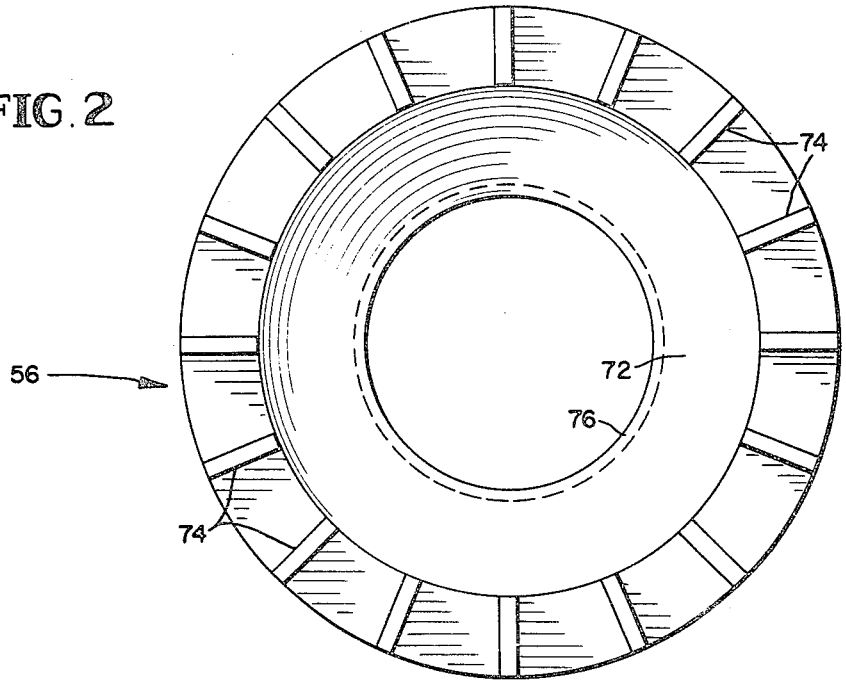
FIG. 2 is a bottom view of an impeller constructed in accord with the principles of the present invention and designed for incorporation in the flotation machine of FIG. 1.
Figure 3:
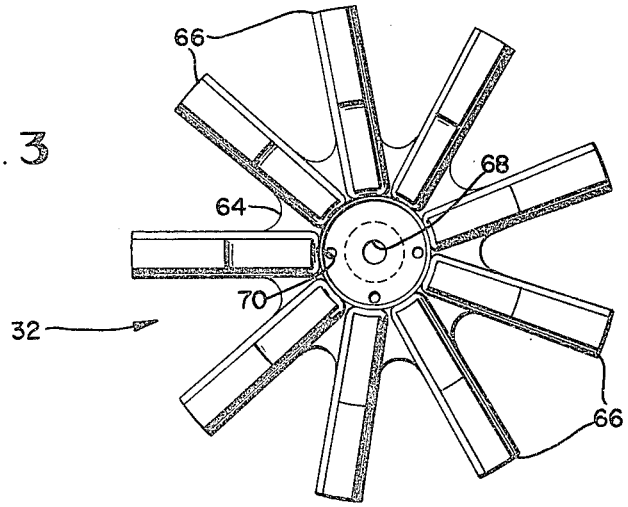
FIG. 3 is a plan view of a diffuser constructed in accord with the principles of the present invention and also designed for the flotation machine of FIG. 1.

As shown in FIGS. 1-3, impeller 32 has a central hub 64 and upstanding, radially extending, equiangularly spaced, generally L-shaped blades or spokes 66. This is an open impeller distinguished in that pulp can be drawn into the impeller from its bottom side as well as through well 31 as shown by arrows 30*b* and 30*a*. Open impellers have the advantage of being less susceptible to bottom side erosion than closed or dish-type impellers like those shown in the above-cited U.S. Pat. Nos. 2,928,543; 2,944,802; 3,140,255; 3,393,802; and 3,393,803 and in Bulletins F10-B119 and F10-B116.

A central aperture 68 in hub 64 and concentric apertures 70 accommodate the bolts 34 and pins 36 by which the impeller is attached to impeller shaft 40.

Diffuser 56, which has a generally U-shaped cross section, is composed of a horizontal flange or hub 72 and depending, radial, equiangularly spaced vanes 74. Diffuser 56 surrounds impeller 32 with vanes 74 adjacent and vertically spanning the spokes 66 of the impeller. A central passage 76 permits the pulp being treated to flow from well 31 to the rotating impeller as shown by arrows 78 in FIG. 1.

In accord with the principles of the present invention impeller 32 and diffuser 56 are each fabricated without a core or insert of an abrasion and corrosion resistant elastomer. Various materials may be used as long as they have the following characteristics:

| | |
|---|---|
| Minimum tensile strength | 2000 psi |
| Minimum tear strength | 125 PLI |
| Minimum modulus of elasticity at 100% elongation | 400 |
| Maximum percent elongation | 600 |
| Minimum durometer (Shore A) | 40 |
| Abrasion resistance (maximum 1055, Tabor index, H-18 wheel) | 100 |
| Maximum percent resilience | 50 |

Among the materials having the foregoing characteristics are polyester and polyether type urethanes. Of these, the polyether type is preferred because it is less susceptible to hydrolisis. Suitable urethanes include Irathane Systems, Inc. 2159 and 210 and DuPont L-83.

Other materials having the foregoing characteristics and therefore useful in the practice of my invention are natural rubbers, styrene-butadiene rubbers, butyl rubbers, nitrile rubbers, and neoprenes, which are elastomers based on polymers of 2-chlorobutadiene-1,3. Other non-metallic, synthetic and natural materials having the properties listed above may also be employed and are fully intended to be covered by the appended claims to the extent that they not expressly excluded therefrom.

The elimination of the heretofore necessary insert from my novel impellers and diffusers increases the apparent resilience of these components and improves wear life. My novel construction also decreases weight and mass moment of inertia, reducing the power consumption of the flotation machines in which they are installed and making them safer to handle. Also, elimination of the insert significantly reduces manufacturing costs, primarily by eliminating the number of steps in the manufacturing process.

Furthermore, these novel components have a unique combination of strength, resilience, and abrasion and corrosion resistance.

Figure 4:
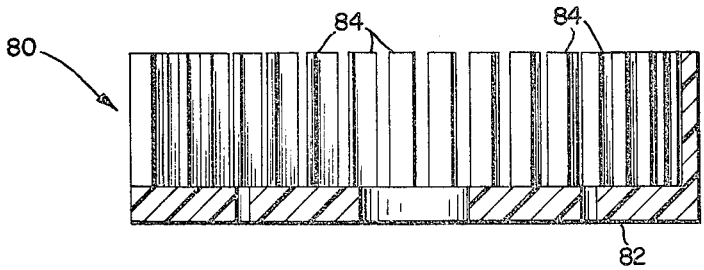
FIG. 4 is a vertical section through another exemplary impeller which can be constructed to advantage in accord with the principles of the invention.

It is to be understood that application of the principles of my invention is by no means limited to the specific components shown in FIGS. 1–3 and discussed above. These principles can also be employed to considerable advantage in the manufacture of components for other machines such as the impeller shown in FIG. 4 and identified by reference character 80. Impeller 80, designed for the Agitair type machine described on pages 12-71 and 12-72 of Taggart, has a circular, horizontal hub or flange 82 with vertically oriented, elongated legs or fingers 84 equidistantly spaced around its periphery. This type of impeller can also be readily and advantageously fabricated without a core or insert from an elastomer as described above.

Also, the principles of the present invention can be employed to advantage in the fabrication of closed, dish-type impellers; for example, those shown in the patents and bulletins identified above. Therefore, to the extent that they are not expressly excluded from the claims which follow, impellers and diffusers embodying the principles of the present invention and flotation machines equipped therewith are fully intended to be covered therein, irrespective of the configuration of these components or the details of the machine in which they are incorporated.

My invention may be embodied in other specific forms without departing from the spirit or essential characteristics therof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A froth flotation machine of the subaeration type which comprises: a tank; an impeller rotatably supported in the bottom of said tank; and means for rotating said impeller; said impeller being fabricated without an internal supporting skeleton component from a non-metallic, abrasion and corrosion resistant, elastomeric material which has the following characteristics:

| | |
|---|---|
| Minimum tensile strength | 2000 psi |
| Minimum tear strength | 125 PLI |
| Minimum modulus of elasticity at 100% elongation | 400 |
| Maximum percent elongation | 600 |
| Minimum durometer (Shore A) | 40 |
| Abrasion resistance (maximum 1055, Tabor index, H-18 wheel) | 100 |
| Maximum percent resilience | 50; |

said impeller having a hub which is symmetrical with the axis of rotation of the impeller and has its major dimension extending at right angles to said axis, said impeller further including elongated, rectilinear blades integrated at one end only with said hub and extending from said hub along paths parallel to said axis of rotation, and said blades being located at the periphery of the impeller at equidistantly spaced intervals therearound.

2. The froth flotation machine as claimed in claim 1 further comprising a diffuser in assembly with said impeller, said diffuser being fabricated without an internal supporting skeleton component from a non-metallic, abrasion and corrosion resistant, elastomeric material which has the following characteristics:

| | |
|---|---|
| Minimum tensile strength | 2000 psi |
| Minimum tear strength | 125 PLI |
| Minimum modulus of elasticity at 100% elongation | 400 |
| Maximum percent elongation | 600 |
| Minimum durometer (Shore A) | 40 |
| Abrasion resistance (maximum 1055, Tabor index, H-18 wheel) | 100 |
| Maximum percent resilience | 50. |

* * * * *